US005169747A

United States Patent [19]

Foss et al.

[11] Patent Number: 5,169,747

[45] Date of Patent: Dec. 8, 1992

[54] RADIATION SENSITIVE ELEMENT WITH A DYE-CONTAINING AUXILIARY LAYERS

[75] Inventors: Robert P. Foss, Hockessin, Del.; Thomas D. Weaver, Rochester, N.Y.

[73] Assignee: E. I. Du Pont de Nemours and Company, Wilmington, Del.

[21] Appl. No.: 871,672

[22] Filed: Apr. 21, 1992

[51] Int. Cl.[5] ..... G03C 1/06

[52] U.S. Cl. ..... 430/518; 430/271; 430/512; 430/517; 430/531; 430/536

[58] Field of Search ..... 430/518, 271, 270, 512, 430/517, 531, 536

[56] References Cited

U.S. PATENT DOCUMENTS

| | | | |
|---|---|---|---|
| 2,548,564 | 4/1951 | Sprague et al. | 95/8 |
| 3,625,691 | 7/1971 | Okyama et al. | 430/518 |
| 3,741,768 | 6/1973 | van Paesschen et al. | 430/518 |
| 3,795,519 | 3/1974 | Miyazako et al. | 96/84 A |
| 4,353,972 | 10/1982 | Helling et al. | 430/518 |
| 4,379,838 | 4/1983 | Helling et al. | 430/518 |
| 4,735,887 | 4/1988 | Foss et al. | 430/264 |
| 4,749,762 | 6/1988 | Foss | 526/312 |
| 4,876,167 | 10/1989 | Snow et al. | 430/518 |
| 4,920,036 | 4/1990 | Totsuha et al. | 430/518 |
| 4,952,484 | 9/1990 | Katoh et al. | 430/518 |
| 5,006,450 | 4/1991 | Facton et al. | 430/518 |
| 5,011,898 | 4/1991 | Foss | 526/234 |

FOREIGN PATENT DOCUMENTS 685475 10/1950 United Kingdom .

*Primary Examiner*—Jack P. Brammer

[57] ABSTRACT

Improved radiation-sensitive elements comprise a support; a radiation-sensitive layer; and an auxiliary layer comprising an absorbing amount of an anionic dye, and a synthetic amphoteric polymer comprising: acrylic acid and N,N-dialkylaminoethyl methacrylate; wherein alkyl=methyl or ethyl, the molar ratio of (a):(b)≦1:1; said polymer has an isoelectric point of 7.0–11.2; and said polymer is present in said auxiliary layer in an amount sufficient to mordant said anionic dye.

11 Claims, No Drawings

RADIATION SENSITIVE ELEMENT WITH A DYE-CONTAINING AUXILIARY LAYERS

FIELD OF THE INVENTION

This invention relates to improved radiation-sensitive elements which comprise auxiliary layers containing amphoteric polymers and anionic dyes.

BACKGROUND OF THE INVENTION

The use of dyes which filter or absorb radiation to prevent unwanted exposure in radiation-sensitive elements is well known. The dye may be present in the radiation-sensitive layer and/or in a separate, auxiliary layer or layers of a multilayer radiation-sensitive element.

The position of the dye-containing auxiliary layer within the element depends upon its purpose. These layers may be: (1) backing layers, positioned on the side of the support opposite that bearing the radiation sensitive layer or layers; (2) undercoat layers, located between the support and the radiation sensitive layer or layers; (3) interlayers, situated between two radiation sensitive layers; and/or (4) overlayers, located on the outermost surface of the radiation-sensitive layer or layers.

Scattered and reflected incident radiation can cause halation, that is, exposure of the radiation sensitive layer in regions in which exposure is not desired. Dye-containing auxiliary layers, known as antihalation layers, absorb radiation reflected and/or refracted from layer-layer interfaces, the layer-support interface, and/or from the back side of the support.

Dye-containing auxiliary layers may also be used as filter layers, that is, layers which absorb incident radiation in one portion of the spectrum while allowing radiation in other spectral regions to pass through and expose a photosensitive layer. A dye-containing auxiliary layer may absorb all the radiation so that, for example, the emulsion on one side of a radiation-sensitive element is not exposed by radiation incident on the other side of the element.

It is generally important that the dye not migrate from the layer in which it is contained, either during or after manufacture of the radiation-sensitive element. Migration of the dye into the radiation-sensitive layer, for example, could have a deleterious effect on the sensitometry of the radiation-sensitive element.

Since residual dye produces an objectionable stain in the final image, it is also important that the dye be completely discharged or otherwise removed from the radiation-sensitive element during processing. Shortened processing times in, for example, X-ray and microfilm processing systems, have reduced the time available for dye removal.

Mordants, which absorb or bind the dye, are sometimes used to prevent dye migration. Processes using mordants to prevent dye migration have been disclosed in a number of patents, for example, Miyazako, U.S. Pat. No. 3,795,519. However, to prevent dye stain, the mordant must quickly and efficiently release the dye during processing. Factor, U.S. Pat. No. 5,006,450, for example, discloses the use of mordant polymers containing selected cationic groups to prevent dye migration.

Despite the advances which have been made, a need exists for polymers which prevent dye migration, but do not increase development time and/or dye stain.

SUMMARY OF THE INVENTION

This invention is a radiation-sensitive element comprising:

(A) a support;

(B) a radiation-sensitive layer; and (C) an auxiliary layer comprising:

(1) an absorbing amount of an anionic dye, and (2) a synthetic amphoteric polymer comprising:

(a) acrylic acid and (b) N,N-dialkylaminoethyl methacrylate;

wherein alkyl=methyl or ethyl, the molar ratio of (a):(b)$\leqq$1:1; said polymer has an isoelectric point of 7.0–11.2; and said polymer is present in said auxiliary layer in an amount sufficient to mordant said anionic dye.

In a preferred embodiment of this invention, the synthetic amphoteric polymer has an isoelectric point of 7.4–11.0. In a preferred embodiment the polymer additionally comprises (c) one or more monomers selected from the group consisting of: $C_{1-8}$ alkyl acrylates and methacrylates, 2-hydroxyethyl acrylate and methacrylate, and 2-hydroxypropyl acrylate and methacrylate.

DETAILED DESCRIPTION OF THE INVENTION

Dye Containing Layer

Amphoteric Polymers

The dye containing auxiliary layer comprises a water-soluble, synthetic amphoteric polymer having an isoelectric point of 7.0–11.2. Preferably, the isoelectric point is in the range of about 7.4–11.0; more preferably, in the range of about 7.8–11.0. As is well known to those skilled in the art, isoelectric point is defined as the pH at which the net charge of the polymer is zero. At this pH the polymer contains an equal number of positive and negative groups. The isoelectric point of gelatin, for example, is typically 4.7. Isoelectric points can be measured by conventional techniques.

Processes for preparing water-soluble, amphoteric polymers by the hydrolysis of prepolymers are disclosed in Foss, U.S. Pat. No. 4,749,762, and Foss and Fruge, U.S. Pat. No. 4,735,887. These polymers are preferably comprised of the following monomers: (a) acrylic acid; (b) N,N-dimethylaminoethyl methacrylate and/or N,N-diethylaminoethyl methacrylate; and, optionally, and preferably, (c) one or more monomers selected from the group consisting of: $C_{1-8}$ alkyl acrylates and methacrylates, 2-hydroxyethyl acrylate and methacrylate, and 2-hydroxypropyl acrylate and methacrylate.

These polymers are preferably prepared by polymerization, preferably emulsion polymerization, of monomer(s) (b) and, if present, (c) with the methyl ester of (a) to produce a prepolymer. The prepolymer is selectively hydrolyzed with base to produce the amphoteric polymer. Alternatively, monomers (a), (b), and, if present, (c) can be polymerized in the presence of a strong acid in a quantity sufficient to protonate the amine group of (b). Amphoteric polymers prepared by these processes are substantially free of betaine-type contaminants.

The prepolymers may be prepared by either continuous or batch processes. Preferably, polymerization is carried out by emulsion polymerization techniques because the reaction proceeds more rapidly than by solution techniques. Emulsion polymerization can be carried out by procedures well know to those skilled in the art, preferably using potassium persulfate as the polymerization initiator. Polymerization temperature is preferably about 50° C. to 70° C., although with a redox initiator system, such as, for example, potassium persulfate/N,N-dimethylaminoethanol, temperatures as low as about 0° C. can be used.

Following polymerization to form the prepolymer, the prepolymer is hydrolyzed to form the amphoteric polymer. During hydrolysis, acrylate ester groups are rapidly converted to carboxylate salts by added base. Since the rate of base catalyzed hydrolysis is much faster for the acrylate ester groups than for the methacrylate ester groups present in the prepolymer substantially all the acrylate esters may be converted to carboxylate groups while no significant conversion of the methacrylate groups to carboxylate groups takes place during hydrolysis. If a limiting quantity of base is used, hydrolysis will proceed only until the base is consumed. Hence the degree of prepolymer hydrolysis and therefore the ratio of carboxyl to amino in the polymer can be regulated by the amount of base used for hydrolysis.

Hydrolysis of the prepolymer is preferably carried out with aqueous potassium hydroxide, preferably in about 10% to 20% in base, and preferably at a temperature of 60° C. to 90° C. Neutralization of the amphoteric polymer thus formed can be accomplished by addition of a strong acid, such as, for example, nitric or hydrochloric acid. The amphoteric polymer can be separated from solution by isoelectric precipitation in excess water. The precipitated amphoteric polymer can be redissolved at a pH other than the isoelectric point. Alternatively, neutralization can be accomplished with an acidic ion exchange resin. Slightly less than the calculated amount of resin is usually employed to facilitate removal of the amphoteric prepolymer solution, which can be used directly, if desired.

The isoelectric point will be governed by the molar ratio of acidic monomer (a) to basic monomer (b) present in the polymer. The molar ratio of (a):(b) must be $\leqq$ 1:1. The molar ratio of (a) to (b) is preferably in the range of 1:1 to about 1:10, more preferably 1:1 to about 1:4. These polymers preferably contain greater than about 10% by weight, more preferably about 10–50% by weight, of (c). A preferred monomer for (c) is methyl methacrylate.

The polymer must be of sufficient molecular weight to mordant the dye, but not be of such high molecular weight that it adversely affects the manufacturability or other properties of the radiation-sensitive system. If the molecular weight of the polymer is too low, it may be leached out during processing. Polymers with $M_w$ in the range of about 20,000 to 150,000, preferably 60,000–120,000, may be used to advantage.

Dyes

Water soluble dyes which can be mordanted by the amphoteric polymers are those which have at least one ionizable acidic group, such as, for example, —COOH or —$SO_3H$. Such dyes are well known in the art, as described, for example, in Miyazako, U.S. Pat. No. 3,795,519 and U.S. patent application 07/606,305, filed Oct. 31, 1990. Such dyes include, for example, acidic mono-, tri-, and pentamethine oxonols, carbo- and dicarbocyanines, merocyanines, indoleniums, azos, triphenylmethanes, tetrazines, and barbituric acids. Examples include: Oxonol Yellow, Oxonol Red 536; Tartrazine; and Acid Violet 520T. As is well known to those skilled in the art, an dye whose absorption corresponds to the radiation to be absorbed will be chosen for use in the auxiliary layer.

Other Components

Preferably the auxiliary layer also comprises: (1) an aqueous dispersion of gelatin, and/or a gelatin substitute, such as, polyvinyl alcohol, dextran, cellulose derivatives, modified gelatin, water-soluble latex, etc.; (2) at least one crosslinking agent, such as, aldehydes, polyfunctional aziridines, etc.; and, optionally, but preferably, (3) at least one dispersing agent or surfactant. Gelatin, cross-linked by an aldehyde, such as, for example, formaldehyde, glyoxyl, or glutaraldehyde, is preferred. The aldehyde must be added in sufficient quantity to cross-link the gelatin. Preferably at least one dispersing agent or coating aid, for example, an anionic surfactant, such as, for example, sodium lauryl ether sulfate or a polyoxyethylene ether, is added.

A polyfunctional aziridine, such as XAMA-7® (Cordova Chemical) or PFAZ® (Sybron Corp.) may be added to cross-link the amphoteric polymer to prevent leaching. About 2–10 equivalent %, based on the amount of carboxyl present, is typically adequate to cross-link the polymer without significantly affecting the mordanting power of the polymer. It is preferred that as little polyfunctional aziridine as possible, preferably about 2 equivalent %, be used. Addition of low levels of polyfunctional aziridine will typically not significantly increase the isoelectric point of the amphoteric polymer.

Composition

The amphoteric polymer must be present in the auxiliary layer in sufficient quantity to mordant the dye. It is preferred that the amount of amphoteric polymer in the auxiliary layer be kept as small as possible. This will depend on the amount of amine present in the amphoteric polymer, the amount of dye to be bound, the isoelectric point of the polymer, and the coating weight of the dye containing layer. Layers which contain 0.6–4 milliequivalents, preferably 1–3 milliequivalents, of binding sites per $m^2$ of coating will generally be adequate to mordant the dye. This typically corresponds to 0.2–2 g of amphoteric polymer per $m^2$.

An absorbing amount of dye must be present. "Absorbing amount" means an amount of dye at least sufficient to achieve the desired effect. If the dye is present in an antihalation layer, an amount sufficient to impart antihalation properties to the layer, that is, absorb sufficient scattered and reflected radiation to improve image quality, yet not sufficient to cause any deleterious side effects, such as, for example, loss of photospeed, must be present. For auxiliary layers an optical density of about 0.2 to 0.3 at the wavelength used for imaging is preferred for most photographic applications. If the dye is present in a filter layer, an amount of dye sufficient to absorb the desired wavelength(s) of light to prevent exposure of the layer beneath the filter layer must be present.

Using techniques well known to those skilled in the art, the concentration of dye required to attain the required optical density can be calculated from the thickness of the auxiliary layer and the absorption spectrum of the dye, which can be determined by conventional spectrophotometric techniques.

The layer can be coated using conventional coating techniques. It must be of sufficient thickness to achieve its desired purpose. Typical coating weights are about 20 mg/dm$^2$ to 100 mg/dm$^2$, preferably 35 mg/dm$^2$ to 65 mg/dm$^2$.

Radiation-sensitive Layer/Support

The radiation-sensitive layer or layers of the radiation-sensitive element comprises a component which is responsive to actinic radiation. The radiation-sensitive component is, preferably, a conventional gelatino silver halide emulsion or a hydrophilic colloid silver halide emulsion. Conventional photographic silver halide emulsions employing any of the commonly known halides, such as silver chloride, silver bromide, silver iodide, and mixture thereof, may be used. These may be of varied content and may be negative and/or positive working.

The preparation of silver halide emulsions is well known in the art. Silver halide emulsions; their preparation; the preparation of radiation-sensitive layers and elements therefrom; and additives useful in said radiation-sensitive emulsions, layers, and elements, are described, for example, in: *Research Disclosure,* , Item 17643, December, 1978; *Research Disclosure,* Item 18431, August, 1979; *Research Disclosure,* Item 22534, January, 1983; and Abbott, U.S. Pat. No. 4,425,426.

The radiation-sensitive layer also comprises a vehicle. Such vehicles are well-know in the art and include the materials useful as vehicles for the auxiliary layer, described above. A preferred vehicle is gelatin.

The layer may be hardened by addition of a conventional hardening agent, such as, for example, formaldehyde, glutaraldehyde, or glyoxal. Conventional additives may also be present in the radiation-sensitive layer for specific purposes, such as, for example, to enhance and stabilize the response of the emulsion. Typical additives include, for example, antifoggants, emulsion stabilizers, image stabilizers, and sensitizing dyes.

The element may comprise any of a number of the other conventional additives, such as are disclosed in any of listed references. These include, for example, optical brighteners, antifoggants, emulsion stabilizers, image stabilizers, dyes, intergrain absorbers, light-scattering materials, coating aids, surfactants, plasticizers and lubricants, matting agents, development inhibitor-releasing compounds, etc.

The element may also comprise any of a number of conventional auxiliary layers, such as, for example, overcoat layers, interlayer and barrier layers, antistat layers, other antihalation or filter layers, etc. The element may be overcoated with a conventional gelatin abrasion layer.

The support can be any of a number of supports for radiation-sensitive elements known in the art. These include polymeric films such as, for example: cellulose ester, such as, for example cellulose triacetate, etc.; polyesters of dibasic aromatic carboxylic acids and divalent alcohols, such as, for example, poly(ethylene terephthalate), poly(ethylene isophthalate), etc.; paper; polymer coated paper; copolymerized vinyl compounds, such as, for example, vinyl acetate/vinyl chloride copolymer; polystyrene; polyacrylates; etc. If desired, dyes may be incorporated into the support to impart a color thereto.

Preferred supports include polyesters made according to Alles, U.S. Pat. No. 2,779,684. These supports are particularly suitable because of their dimensional stability. A particularly preferred support is poly(ethylene terephthalate). The film support may be subbed on each side with a thin, anchoring substratum of a conventional resin sublayer, over which may be applied a gelatin sublayer. The mixed polymer resin subbing compositions of vinylidene chloride-itaconic acid taught by Rawlins, U.S. Pat. No. 3,567,452, may be used to advantage.

The element can be prepared by coating the layers onto the support using coating techniques which are conventional in the art.

The auxiliary layer or layers can be located in any place in the photosensitive element where it is desired to absorb light. The layer may be (1) a backing layer, positioned on the side of the support opposite that bearing the radiation sensitive layer or layers; (2) an undercoat layer, located between the support and the radiation sensitive layer or layers; (3) an interlayer, situated between two radiation sensitive layers; and/or (4) a filter layer, located above (i.e., on the outermost surface of) the radiation-sensitive layer or layers.

The photosensitive element, following exposure by a conventional process, can be processes to yield an image. During processing the dye will be removed.

Processing can be any conventional type, such as described in *Research Disclosure,* , December 1978, Item 17643, Sections XIX-XXIV, provided the developer is of sufficiently high pH to remove the anionic dye (i.e., higher than the isoelectric point of the amphoteric polymer).

The photosensitive elements of this invention are useful for image reproduction. Such elements are used, for example, in photography, X-ray, microfilm, graphic arts, etc. These elements are particularly useful in applications, such as X-ray and microfilm, in which the dye must be removed quickly and efficiently during short processing times.

The advantageous properties of this invention can be observed by reference to the following examples which illustrate, but do not limit, the invention.

EXAMPLES

| GLOSSARY | |
|---|---|
| Acid Violet 520T | Hemioxonol on base of an acidic pyrazolone derivative; CAS 112462-21-2; Riedel-de Haen Seelze, Germany |
| DMAEMA | 2-(N,N-Dimethylamino)ethyl methacrylate |
| MA | Methyl acrylate |
| MMA | Methyl methacrylate |
| Oxonol Red 536 | Trimethine oxonol based on an acidic pyrazolone derivative; Riedel-de Haen |
| Oxonol Yellow | Monomethine oxonol based on an acidic pyrazolone derivative; CAS 137061-47-3; Riedel-de Haen |
| PFAZ ® | 1,1,1-Trimethylolpropane tris(2-methyl-1-aziridine propionate; CAS 64265-57-2; Sybron Chemical, Birmingham, NJ 08011 |
| Tartrazine | 4,5-Dihydro-5-oxo-1-(4-sulfophenyl)-4-[(4-sulfophenyl)azo]-1H-pyrazole-3-carboxylic acid trisodium salt; C.I. 19140; FD&C Yellow No. 5 |

EXAMPLE 1

This example illustrates preparation of a prepolymer from MA, MMA, and DMAEMA (1:5:4), and hydrolysis of the prepolymer to form an amphoteric polymer containing AA/MMA/DMAEMA (1:5:4).

Prepolmery Formation

A 1 L jacketed resin kettle with drain was fitted with a thermocouple probe for monitoring the reaction temperature, an FMC piston metering pump for introducing the initiator solution, a mechanical stirrer consisting of a Waring blender blade attached to the end of an anchor stirring shaft and driven by a T-line electric motor, a nitrogen head to maintain an inert atmosphere over the reaction mixture, and a hot water bath and circulating pump for heating the reactor. An emulsifier solution of 5 g Triton® QS-30 and 5 g of N,N-dimethylaminoethanol in 500 mL of distilled water was placed in the reactor and heated to 60° C. A monomer mixture containing 10.6 g (0.124 mol) of MA, 61.7 g (0.618 mol) of MMA, and 77.6 g (0.494 mol) of DMAEMA was added.

The reaction mixture was stirred to form an emulsion. Then an initiator solution containing 2.5 g of ammonium persulfate in 100 mL of distilled water was added at a rate of 0.74 mL/min. The reaction was continued until all the initiator had been added. An emulsion sample was removed and coagulated by the addition of enough acetone to break the emulsion. The prepolymer was washed with water, dissolved in acetone, reprecipitated from petroleum ether, and dried to produce a sample of prepolymer. Analysis: Calculated for MA/MMA/DMAEMA (1:5:4): C, 60.30%; H, 8.73%; N, 4.61%. Found: C, 58.75%; H, 8.51%; N, 4.35%. $M_w$, 80,800.

Hydrolysis to Amphoteric Polymer

Ethanol (500 ml) was added to the reactor and the reaction mixture heated to 80° C. Aqueous potassium hydroxide (8.31 g [0.143 mol] dissolved in 50 mL of water) was added to the reaction mixture through an addition funnel to hydrolyze the prepolymer. The reaction mixture was held at 80° C. for 1 hr following addition of base.

The polymer was neutralized by addition of a 5% excess (based on the amount of KOH added) of hydrochloric acid (0.155 mol). Precipitated potassium chloride was removed by centrifugation. The polymer, 148 g (98% yield), was stored in the water/alcohol solution (14.1% solids) at pH 6. Isoelectric point, greater than 7.6.

EXAMPLE 2

This example illustrates preparation of a prepolymer from MA, MMA, and DMAEMA (1:2:2) and hydrolysis of the prepolymer to form an amphoteric polymer containing AA/MMA/DMAEMA (1:2:2).

The procedure of Example 1 was repeated except that a mixture of 21.5 g of MA (0.25 mol), 50 g of MMA (0.50 mol), and 78.5 g of DMAEMA (0.50 mol) was used. A sample of the prepolymer was isolated. Analysis: Calculated for MA/MMA/DMAEMA (1:2:2): C, 60.00%; H, 8.67%; N, 4.67%. Found: C, 59.70%; H, 8.50%; N, 4.26%. $M_w$ 98,100.

Hydrolysis of the prepolymer was carried out with 16.8 g (0.3 mol) of potassium hydroxide in 50 mL of water. Neutralization was carried out with 31 mL (0.31 mol) of hydrochloric acid. Isoelectric point, 8.4. The polymer, 143 g (95%), was stored in the water/alcohol solution at pH 6.

EXAMPLE 6

This example illustrates the uptake of anionic dyes by layers containing amphoteric polymers.

Dye (1 g) was dissolved in 100 mL of 0.5% aqueous acetic acid and the pH adjusted to 5.4 with 0.6N aqueous sodium hydroxide.

A 7.5% gel solution was prepared by dissolving 7.5 g of gelatin in 100 mL of distilled water. The pH was adjusted to 4.0 with 3N sulfuric acid. Ethanol (0.75 mL) was added to each of: (1) a 4 g sample of gel solution, (2) a 3 g sample of gel solution, and (3) a second 3 g sample of gel solution, and the solutions were mixed well. To sample (2) was added 0.25 g of the solution of amphoteric polymer (AA/MMA/DMAEMA, 1:5:4) prepared in Example 1. To sample (3) was added 0.50 g of the solution of polymer prepared in Example 1. Sufficient water was added to each of the three samples to bring the total weight of the sample to 6.0 g. Then 0.25 g of 1.3M aqueous formaldehyde and 0.1 g of 10% Triton® X-102 surfactant were added to each sample. The gel solutions were coated on conventional resin subbed polyethylene terephthalate film base with a #22 wire-wound metering rod at about 42 mL/m$^2$. The coatings were dried with warm air.

Coatings with and without polymer present were soaked in dye solution for 5 min and then in distilled water for 5 min and dried with warm air. Absorption spectra were measured from 350–800 nm with a Varian recording spectrophotometer. The absorbance at the wavelength of maximum absorption for each dye is given in Table 1.

TABLE 1

OPTICAL DENSITY AS A FUNCTION OF COATING WEIGHT[a]

| Dye | Amphoteric Polymer (g/m$^2$) 0 | 0.23[b] | 0.46[c] |
|---|---|---|---|
| Oxonol Yellow | 0.32 | 0.76 | 1.22 |
| Oxonol Red 535 | 0.44 | 0.99 | 1.6 |
| Tartrazine | 0.12 | 0.39, | 0.69 |
| Acid Violet 520T | 1.42 | 2.55 | 3.49 |

[a]Wavelengths: Oxonol Yellow, 380–400 nm; Oxonol Red 536, 550–555 nm; Tartrazine, 400–430 nm; and Acid Violet 520T, 500–550 nm.
[b]0.79 meq of cation/m$^2$.
[c]1.59 meq of cation/m$^2$.

EXAMPLE 4

This example illustrates that amphoteric polymers mordant various anionic dyes.

The procedure of Example 3 was followed to prepare coatings containing the amphoteric polymer (AA/MMA/DMAEMA, 1:2:2) prepared in Example 2.

To obtain initial values, coatings with and without polymer present were soaked in dye solution for 5 min and then in distilled water for 5 min and dried with warm air. Absorption spectra were measured from 350–800 nm with a Varian recording spectrophotometer. To demonstrate mordant ability, samples with and without polymer present were soaked (95° F.) for varying periods of time, dried with warm air, and the absorption spectra determined as above. Absorption as a function of soak time for each dye is given in Table 2.

TABLE 2

| Dye[a] | Coating Wt.[b] (g/m²) | Optical Density[c] 0 min | 1 min | 2 min | 5 min |
|---|---|---|---|---|---|
| OY | 0 | 0.32 | 0.14 | 0.05 | 0.02 |
| " | 0.46[d] | 1.04 | ND[e] | ND | ND |
| " | 0.93[f] | 1.67 | 1.18 | 1.14 | 0.96 |
| OR | 0 | 0.44 | 0.23 | 0.1 | 0.02 |
| " | 0.46 | 1.21 | ND | ND | ND |
| " | 0.93 | 2.01 | 1.8 | 1.62 | 1.48 |
| T | 0 | 0.12 | 0.05 | 0 | 0 |
| " | 0.46 | 0.55 | ND | ND | ND |
| " | 0.93 | 0.99 | 0.78 | 0.7 | 0.66 |
| AV | 0 | 1.42 | 1.11 | 0.7 | 0.05 |
| " | 0.46 | 2.99 | ND | ND | ND |
| " | 0.46[g] | 3.49 | >3 | 2.88 | 2.4 |
| " | 0.93 | 3.53 | >3 | >3 | >3 |

[a]OY = Oxonol Yellow; OR = Oxonol Red 535; T = Tartrazine; AV = Acid Violet 520T.
[b]Amount of amphoteric polymer present.
[c]As a function of soak time in 5% aqueous gelatin solution at 35° C.
[d]1.45 meq of cation/m².
[e]Not determined.
[f]2.9 meq of cation/m²
[g]The amphoteric polymer prepared in Example 1 was used in this evaluation; 1.6 meq cation/m².

EXAMPLE 5

This example demonstrates that dyes are readily removed during development when a variety of amphoteric polymers are used.

The amphoteric polymers listed in Table 3 were prepared by the procedure of Example 1 or by the procedures disclosed in Foss, U.S. Pat. No. 4,749,762. The polymers were not isolated, but were handled in aqueous solution.

TABLE 3

| Polymer # | AA/MMA/DMAEMA | Mw | IP[a] | [Conc.][b] |
|---|---|---|---|---|
| 1 | 1/2/1 | ND[c] | 7.0 | 10.1 |
| 2 | 1/1/1 | 23,700 | 7.4 | 15.5 |
| 3 | 1/5/4 | 67,000 | 7.6 | 7.6 |
| 4 | 1/2/2 | 44,200 | 7.9 | 9.4 |
| 5 | 1/1/2 | 66,000 | 8.4 | 15.2 |
| 6 | 1/1/4 | 52,800 | 9.2 | 14.4 |

[a]Isoelectric point
[b]Solution concentration, % (wt/wt)
[c]Not Determined

The following polymer solutions were added to separate sample bottles: #1, 5.12 mL; #2, 2.53 mL; #3, 1.38 mL; #4, 3.71 mL; #5, 1.91 mL; #6, 1.67 mL. Sufficient 4N acetic acid was added to each sample to adjust the pH to 4–6 followed by enough water to bring the total weight to 9.0 g. Then 9.0 g of a 7.5% gel solution, adjusted to pH 5.2–5.4 with 3N sulfuric acid and heated to about 38° C., was added to each sample. The samples were stirred with a glass rod until homogeneous. Then 0.50 g of 1.3M aqueous formaldehyde and 0.3 g of 10% Triton ® X-102 surfactant were added to each sample. The gel solutions were coated on conventional resin subbed polyethylene terephthalate film base with a #26 wire-wound metering rod. The coatings were dried with warm air.

A sample of each coating was soaked for 2 min in a solution prepared by adding 25 g of glutaraldehyde to 0.5 L of 0.1N sodium hydroxide and adjusting the pH to 7.5 with acetic acid. Each sample was dried in warm air. Each sample was soaked for 5 min in a dye solution prepared by dissolving Oxonyl Red 536 (1 g) in 100 mL of 0.5% aqueous acetic acid and adjusting the pH to 5.4 with 0.6N aqueous sodium hydroxide. Then each sample was soaked in water for 5 min with stirring and dried with warm air. Absorption spectra were determined as described above.

To demonstrate mordant ability, samples with and without polymer present were soaked in 5% aqueous gelatin solution at 35° C. for varying periods of time, dried with warm air, and the absorption spectra determined as above. To demonstrate that the dye is readily removed by developer, a sample of each dyed coating was soaked in Cronalith ® Universal Fast Developer (E. I. du Pont de Nemours and Co., Wilmington, Del.) for 30 sec. Optical absorption as a function of soak time is given in Table 4.

TABLE 4

| Polymer | Gel Soak[a] 0 min | 1 min | 2 min | 5 min | Developer Soak[b] |
|---|---|---|---|---|---|
| None | 0.12 | 0.03 | 0.0 | 0.0 | 0.0 |
| 1 | 2.18 | 1.51 | 1.30 | 1.12 | 0.0 |
| 2 | 0.72 | 0.47 | 0.28 | 0.22 | 0.0 |
| 3 | 0.67 | 0.51 | 0.39 | 0.33 | 0.0 |
| 4 | 2.16 | 1.85 | 1.73 | 1.53 | 0.0 |
| 5 | 1.18 | 1.03 | 0.68 | 0.59 | 0.0 |
| 6 | 2.19 | 1.94 | 1.68 | 1.58 | 0.0 |

[a]5% aqueous gelatin at 35° C. for the indicated time.
[b]30 sec in Cronalith ® Universal Fast Developer.

The sample containing polymer 6 which had been soaked in 5% aqueous gelatin for 5 min was soaked an additional 10 min in 5% aqueous gelatin (total soak time: 15 min). The measured optical absorption was 1.52.

EXAMPLE 6

This example demonstrates cross-linking of the amphoteric polymer with a polyfunctional aziridine.

A solution of 6% aqueous gelatin was prepared and the pH adjusted to 5.4–5.6 with 0.3N sulfuric acid. To each of two 15 g aliquots of gelatin solution was added 5 g of water and 0.29 g of a 26% ethanol solution of Polymer #3 of Example 5. A solution of 1 g of PFAZ ® in 2-propanol was prepared, and 1 mL of this solution diluted with 1 mL of water before addition to the gel/amphoteric polymer solution. The amount added is shown in Table 5.

The pH of the resulting solutions was adjusted to 5.4–5.6 with 0.3N aqueous sulfuric acid and 1.0 mL of a solution of 1.28 g of Acid Violet in 20 mL of water, adjusted to pH 5.4–5.6 with 0.3N aqueous sulfuric acid, was added. The solutions were coated onto conventional resin subbed polyethylene terephthalate film base with a #15 wire-wound metering rod and dried in warm air.

The resulting coatings were heated in an oven for 18 hr at 50° C. and the visible spectra recorded. Each coating was soaked in 5% gel solution at pH 5.4–5.6 at 38° C. for 3 min and washed in deionized water at 38° C. The coatings were dried and the visible spectra again determined. Results are given in Table 5.

TABLE 5

| PFAZ ® Added (mL) | Optical Density Before Soak | After Soak |
|---|---|---|
| 0.1 | 0.38 | 0.43 |
| 0.3 | 0.42 | 0.31 |

After the coatings were processed in a standard developer, there was little or no dye stain.

What is claimed is:

1. A radiation-sensitive element comprising:

(A) a support;

(B) a radiation-sensitive layer; and (C) an auxiliary layer comprising:

(1) an absorbing amount of an anionic dye, and (2) a synthetic amphoteric polymer comprising:

(a) acrylic acid and (b) N,N-dialkylaminoethyl methacrylate;

wherein alkyl=methyl or ethyl; the molar ratio of (a):(b)≦1:1; said polymer has an isoelectric point of 7.0–11.2; and said polymer is present in said auxiliary layer in an amount sufficient to mordant said anionic dye.

2. The element of claim 1 wherein the molar ratio of (a):(b) is in the range of 1:1 to about 1:10.

3. The element of claim 2 wherein said polymer is substantially free of betaine-type contaminants.

4. The element of claim 3 wherein said synthetic amphoteric polymer is cross-linked with 2–10 equivalent % based on the amount of carboxyl present, of a polyfunctional aziridine.

5. The element of claim 2 wherein said polymer has an isoelectric point of 7.4–11.0.

6. The element of claim 5 wherein said polymer additionally comprises (c) one or monomers selected from the group consisting of: $C_{1-8}$ alkyl acrylates and methacrylates, 2-hydroxyethyl acrylate and methacrylate, and 2-hydroxypropyl acrylate and methacrylate.

7. The element of claim 6 wherein (c) comprises about 10–50% by weight of said polymer.

8. The element of claim 7 wherein the molar ratio of (a):(b) is in the range of 1:1 to about 1:4.

9. The element of claim 7 wherein said polymer is substantially free of betaine-type contaminants.

10. The element of claim 9 wherein (c) is methyl methacrylate.

11. The element of claim 10 wherein said synthetic amphoteric polymer is cross-linked with 2–10 equivalent based on the amount of carboxyl present, of a polyfunctional aziridine.

* * * * *